US005295304A

United States Patent [19]

Ashley, Jr.

[11] Patent Number: 5,295,304

[45] Date of Patent: Mar. 22, 1994

[54] METHOD FOR PRODUCING A FULL FACE FABRICATED WHEEL

[75] Inventor: Walter L. Ashley, Jr., Detroit, Mich.

[73] Assignee: Hayes Wheels International, Inc., Romulus, Mich.

[21] Appl. No.: 54,373

[22] Filed: Apr. 28, 1993

[51] Int. Cl.[5] ..... B21K 1/28

[52] U.S. Cl. ..... 29/894.325; 29/DIG. 32; 301/63.1

[58] Field of Search ..... 29/894.325, 894.32, 29/DIG. 32; 72/68; 301/63.1

[56] References Cited

U.S. PATENT DOCUMENTS

| | | | |
|---|---|---|---|
| 2,075,294 | 3/1937 | LeJeune | 301/63.1 |
| 2,975,511 | 3/1961 | Johnson | 29/894.325 |
| 2,983,033 | 5/1961 | Cox . | |
| 3,195,491 | 7/1965 | Bulgrin et al. . | |
| 3,262,191 | 7/1966 | Albertson et al. . | |
| 3,823,591 | 7/1974 | Schroder et al. . | |
| 4,610,482 | 9/1986 | Overbeck et al. | 301/63.1 |

*Primary Examiner*—P. W. Echols

*Attorney, Agent, or Firm*—MacMillan, Sobanski & Todd

[57] ABSTRACT

An improved method for producing a full face fabricated wheel. The method includes the steps of: (a) providing a rim defining an axis and including an axially extending well and a pair of opposed ends, one of the ends including an inboard tire bead seat retaining flange and an inboard tire bead seat, and the other end including an outboard tire bead seat; (b) providing a disc blank including an inner annular portion defining a wheel mounting surface; (c) flow spinning the disc blank to form an intermediate annular portion having a predetermined contour and an outer annular portion; (d) stamping the outer annular portion of the disc to form an outboard tire bead seat retaining flange of the full face wheel; (e) positioning the outboard tire bead seat retaining flange of the disc adjacent the outboard tire bead seat of the rim; and (f) securing the rim and disc together to produce the full face fabricated wheel.

4 Claims, 2 Drawing Sheets

METHOD FOR PRODUCING A FULL FACE FABRICATED WHEEL

BACKGROUND OF THE INVENTION

This invention relates in general to a vehicle wheel and, in particular, to an improved method for producing a full face fabricated wheel.

Conventional fabricated wheels are typically of a two-piece construction and include an inner disc and an outer rim. The disc includes a centrally located wheel mounting surface provided with a center pilot hole and a plurality of lug receiving holes for mounting the wheel to an axle of the vehicle. The rim includes an inboard tire bead seat retaining flange, an inboard tire bead seat, an axially extending well, an outboard tire bead seat, and an outboard tire bead seat retaining flange. In both types of constructions, the disc and the rim are secured together during a welding operation.

Styled fabricated wheels have recently become popular and one type of a styled wheel is a full face wheel. In a full face type wheel, the disc includes an outer annular portion which defines at least a portion of an outboard tire bead seat retaining flange of the wheel. The rim includes an inboard tire bead seat retaining flange, an inboard tire bead seat, a generally axially extending well, and an outboard tire bead seat. In some instances, the outboard tire bead seat of the rim and the outer annular portion of the disc cooperate to form the outboard tire 0 bead seat retaining flange of the full face wheel. In both types of construction, the outboard tire bead seat of the rim is positioned adjacent the outboard tire bead seat retaining flange of the disc, and a weld is applied to secure the rim and the disc together.

A typical sequence of steps which can be used to produce a full face fabricated wheel includes the steps of: (a) providing a flat sheet of suitable material, such as aluminum or steel; (b) forming the sheet into a generally flat circular disc blank; (c) initially stamping the blank to form a partially-shaped disc; (d) progressively stamping the partially-shaped disc during a plurality of intermediate stamping operations to produce a disc having a predetermined shape; (e) final stamping an outer annular portion of the disc to form a bead seat retaining flange thereon which defines an outboard tire bead seat retaining flange of the finish full face wheel; (f) machining an outer edge of the outboard tire bead seat retaining flange of the disc; and (g) securing the disc to a preformed rim to produce the finish full face fabricated wheel.

As a result of forming the full face wheel in this manner, the intermediate stamping operations produce a disc having a generally constant material thickness as the disc is progressively shaped. A slight thinning of the material occurs only at those portions of the disc where the curvature changes and forms a radius. Thus, the generally constant thickness of the disc results in a disc having extra material at places where it is not required for strength purposes. In addition, the outer end of the outboard tire bead seat retaining flange of the disc must be machined to remove excessive material therefrom, in order to provide an end which is thin enough to allow a wheel balancing weight to be secured thereon.

It is known that a flat or a preformed disc blank can be tapered by a flow spinning process to produce a disc for a conventional or a combination wheel as disclosed in U.S. Pat. No. 3,823,591 to Schroder et al., U.S. Pat. No. 3,262,191 to Albertson et al., U.S. Pat. No. 3,195,491 to Bulgrin et al., and U.S. Pat. No. 2,983,033 to Cox.

SUMMARY OF THE INVENTION

This invention relates to an improved method for producing a full face fabricated wheel, wherein a full face disc is formed by combining flow spinning and stamping operations. In particular, prior to the final stamping operation which forms the full face disc, the disc is subjected to a flow spinning process to taper an outer annular portion thereof. The method for producing the full face wheel includes the steps of: (a) providing a generally circular rim defining an axis and including a generally axially extending well and a pair of opposed ends, one of the ends including an inboard tire bead seat retaining flange and an inboard tire bead seat, and the other end including an outboard tire bead seat; (b) providing a generally circular disc blank including an inner annular portion defining a wheel mounting surface; (c) flow spinning the disc blank to form an intermediate annular portion having a predetermined contour and an outer annular portion; (d) stamping the outer annular portion of the disc to form an outboard tire bead seat retaining flange of the full face wheel; (e) positioning the outboard tire bead seat retaining flange of the disc adjacent the outboard tire bead seat of the rim; and (f) securing the rim and disc together to produce the full face fabricated wheel.

Forming the full face wheel by this method results in the finish full face wheel weighing approximately 33% less than a prior art full face wheel. Also, combining flow spinning and stamping operations to produce the full face disc allows tight specifications to be maintained.

Other advantages of this invention will become apparent to those skilled in the art from the following detailed description of the preferred embodiment, when read in light of the accompanying drawings.

BRIEF DESCRIPTION OF THE DRAWINGS

FIG. 2 is a perspective view showing the blank for use in producing the full face fabricated wheel.

FIG. 3 is a perspective view showing the initial stamping of the blank into a partially-shaped disc.

FIG. 4 is a perspective view showing the disc after a flow spinning process.

FIG. 5 is a perspective view showing the finish full face disc after a final stamping operation.

DETAILED DESCRIPTION OF THE PREFERRED EMBODIMENT

Figure 1:
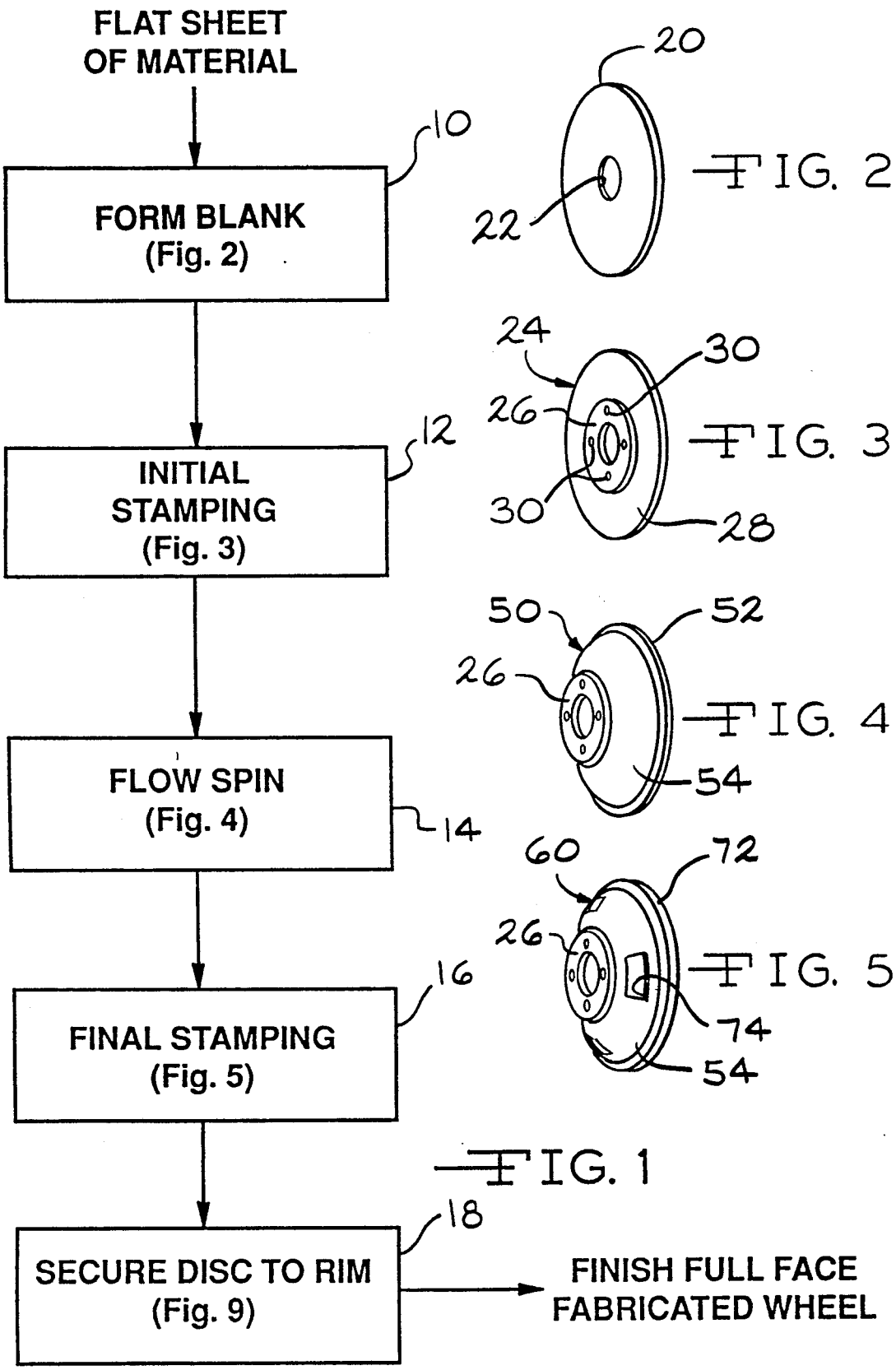
FIG. 1 is a block diagram showing a sequence of steps for producing a full face fabricated wheel constructed in accordance with the present invention.
Figure 9:
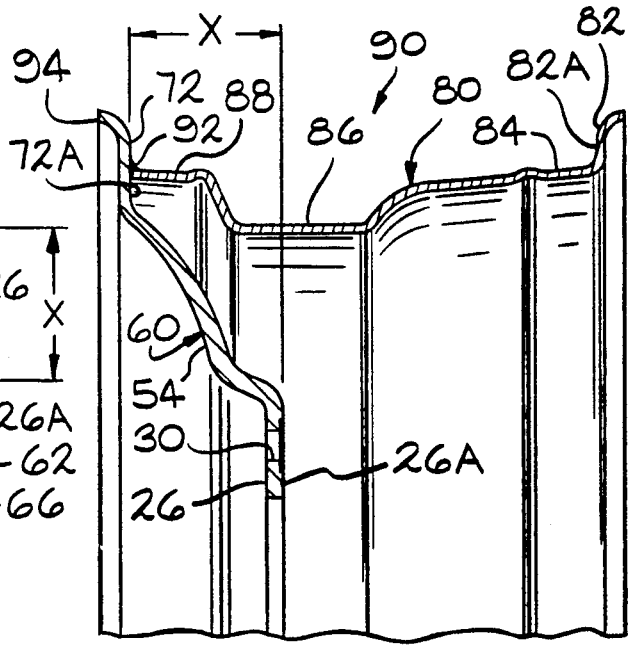
FIG. 9 is a partial sectional view of the finish full face fabricated wheel.

Referring now to the drawings, there is illustrated in FIG. 1 a block diagram showing a sequence of steps for producing a full face fabricated wheel, indicated generally at 90 in FIG. 9, and constructed in accordance with the present invention. Initially, in step 10, a flat sheet of suitable material, such as for example, steel or aluminum, is formed into a generally flat circular blank 20 having a centrally located pilot aperture 22 formed therein, as shown in FIG. 2.

Following step 10, the blank 20 is stamped in step 12 to produce a partially-shaped disc 24, as shown in FIG. 3. The partially-shaped disc 24 includes an inner annular portion 26 which defines a wheel mounting surface, and which is offset from an outer annular portion 28. The inner annular portion 26 includes a plurality of lug receiving apertures 30 formed therein. The lug receiving apertures 30 are equally and circumferentially spaced in the disc 24 around the pilot aperture 22. While four lug receiving apertures 30 are shown as being formed in the partially-shaped disc 24, the actual number of lug receiving apertures 30 is determined by the particular axle assembly upon which the finished full face wheel is to be mounted.

Figure 6:
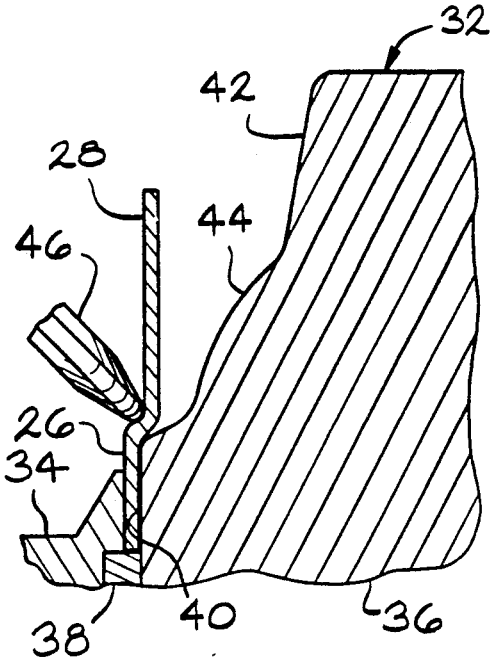
FIG. 6 is a partial elevational view of the partially-shaped disc prior to the flow spinning process.
Figure 7:
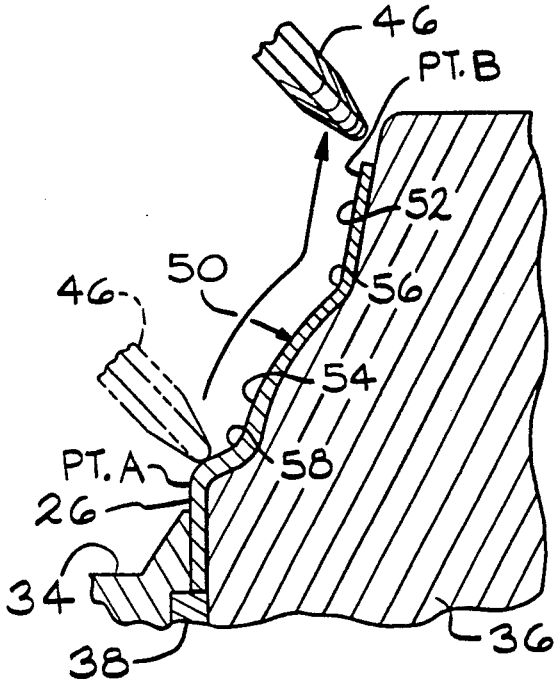
FIG. 7 is a partial elevational view of the disc after the flow spinning process is completed.

As shown in FIGS. 6 and 7, the partially-shaped disc 24 is then supported in a mandrel-tailstock assembly 32, and subjected to flow spinning process in step 14. The mandrel-tailstock assembly 32 is well known and includes a tailstock 34, and a spinning mandrel 36 having a centering pilot member 38. The mandrel 36 is rotatably mounted on headstock (not shown) and is driven by a motor (not shown). The pilot member 38 is provided with a predetermined outer diameter which generally corresponds to the outer diameter of the pilot aperture 22 formed in the partially-shaped disc 24 to create a friction fit therebetween. Thus, when the partially-shaped disc 24 is supported on the mandrel-tailstock assembly 32, relative movement between the disc 24 and the assembly 32 is restricted.

The mandrel 36 is provided with an outer surface having a predetermined contour which, as will be described below, is effective to impart a predetermined contour to the partially-shaped disc 24 during the flow spinning process of step 14. In the embodiment shown in FIG. 6, the outer surface of the mandrel 36 is generally bowl-shaped and includes a generally radially extending centrally-located surface 40, a generally radially extending outer end surface 42, and a generally radially outwardly extending intermediate surface 44.

In accordance with the present invention, once the partially-shaped disc 24 is supported in the tailstock-mandrel assembly 32, a spinning tool 46 is actuated in order to flow spin the disc 24 against the outer surface of the mandrel 36 in step 14. The spinning tool 46 is mounted on a support member (not shown) which allows the spinning tool 46 to generally travel parallel to the profile of the outer surface of the mandrel 36.

During the flow spinning process of step 14, the outer surface of the partially-shaped disc 24 is engaged by the end of the spinning tool 46 and the material of the disc 24 is pushed forward by the tool 46 throughout the entire length thereof, into engagement with the adjacent outer surface of the mandrel 36. As the spinning tool 46 is advanced in the direction of the arrow shown in FIG. 7, the material of the disc 24 is pushed forward by the tool 46 against the mandrel 36, thereby increasing both the axial and radial dimensions of the disc 24 in the embodiment shown in FIGS. 6 and 7 to form a predetermined disc profile which generally corresponds to the profile of the outer surface of the mandrel 34.

The flow spinning of the partially-shaped disc 24 in step 14 produces a generally bowl-shaped flow spun disc 50, as shown in FIGS. 4 and 7. The bowl-shaped disc 50 includes the radially extending wheel mounting surface 26, a generally radially extending outer annular end portion 52, and a generally radially outwardly extending intermediate annular portion 54. As will be discussed below, by using the flow spinning process of step 14 to produce the bowl-shaped disc 50, the outer and intermediate annular portions 52 and 54, respectively, of the disc 50 shown in this embodiment are tapered throughout the entire lengths thereof. As a result of this, a lighter disc is produced, and the disc does not generally require any additional machining operations to remove material in order to attach a balancing weight to the disc, as will be discussed below.

As shown in FIG. 7, the flow spinning process of step 14 forces the material of the disc 24 against the outer surface of the mandrel 36 so as to form slight radii 56 and 58 in the bowl-shaped disc 50 between the outer portion 52 and the intermediate portion 54, and the inner portion 26 and the intermediate portion 54, respectively.

Figure 8:
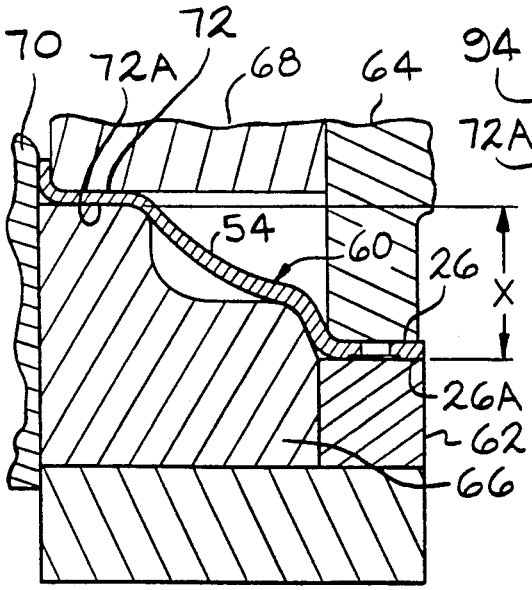
FIG. 8 is a partial elevational view of the finish full face disc after a final stamping operation.

Following step 14, the generally bowl-shaped disc 50 is stamped in a final stamping operation in step 16 to form the finish full face disc 60, shown in FIG. 5. During the final stamping operation of step 16, the inner annular portion 26 of the bowl-shaped disc 50 is engaged by a plurality of dies, only two of such dies 62 and 64 being illustrated. Also, the intermediate and outer tapered annular portions 52 and 54, respectively, are engaged by a plurality of dies, three of such dies 66, 68, and 70 being illustrated, to form a tire bead seat retaining flange 72 in the outer annular tapered portion 52 thereof, as shown in FIG. 8. By forming the tire bead seat retaining flange 72 in this manner, an inner surface 72A of the tire bead seat retaining flange 72 is precisely located a distance X relative to an inner surface 26A of the inner annular portion 26 of the disc 60 in a parallel relationship. As will be discussed below, the tire bead seat retaining flange 72 forms the outboard tire bead seat retaining flange of the finish full face wheel.

In addition, during the final stamping operation of step 16, it is preferable to form a plurality of windows 74, shown in FIG. 5, in the intermediate annular tapered portion 54 of the disc 50. Although four windows 74 having the shape shown in FIG. 5 are illustrated as being formed in the disc 50 during the final stamping operation of step 16, the particular design, arrangement, and number of windows 74 which are formed can vary depending upon the desired final appearance of the disc 60. Furthermore, in some full face wheel designs, no windows 74 are formed in the disc 60.

After forming the tire bead seat retaining flange 72 in the disc during step 16, the disc 60 is then secured to a rim 80 having a predetermined shape in step 18. As shown in FIG. 9, the rim 80 includes an inboard tire bead seat retaining flange 82 having an outer surface 82A, and inboard tire bead seat 84, a generally axially extending well 86, and an outboard tire bead seat 88.

In particular, the outboard tire bead seat 88 of the rim 80 is positioned adjacent the outboard tire bead seat retaining flange 72 of the disc 60, and a circumferentially extending continuous, air-tight weld 92 is applied in step 18 to secure the rim 80 and disc 60 together to produce a finish full face fabricated wheel 90, shown in FIG. 9. Once the disc 60 and rim 80 are welded together in step 18, the tire bead seat retaining flange 72 of the disc 58 is effective to define the outboard tire bead seat retaining flange for the finish full face wheel 90. Also, the inner surface 72A of the outboard tire bead seat retaining flange 72, the inner surface 26A of the inner annular portion 26, and the outer surface 82A of the inboard tire bead seat retaining flange 82 are located parallel to one another and perpendicular relative to the axis of the wheel 90.

One advantage of the present invention is that by combining flow spinning and stamping operations to produce the full face disc 60, tight specifications can be maintained as the disc is both axially and radially increased by these operations. As a result of this, less scrap material is produced. Also, the outer annular portion 54 of the disc 50 produced by the flow spinning process of step 14 can be tapered to a predetermined thickness. As a result of this, the outboard tire bead seat retaining flange 72 formed during the final stamping operation of step 16 includes an outermost end 94 which is thin enough to allow a wheel balancing weight (not shown) to be mounted thereon without requiring any additional machining to reduce the thickness thereof.

In the prior art stamping method, since the thickness of the material was generally constant throughout the entire disc, the outermost end of the bead seat retaining flange had to be machined in order to reduce the thickness thereof, to allow a wheel balancing weight to be secured thereon. This is important because a standard wheel balancing weight is designed to be mounted on the outermost end of a wheel having a maximum thickness of approximately 0.150 inches or less. According to the method of the present invention, a blank having an initial thickness at a point A of approximately 0.350 inches can be flow spun in step 16 to produce a thickness at a point B of about 0.150 inches or less. Following step 16, the final stamping operation of step 16 produces an outboard tire bead seat retaining flange 72, wherein the outermost end 94 thereof includes a thickness of about 0.150 inches or less.

Also, the tapering of the partially-shaped disc 24 in step 14 by the flow spinning process is a cold working of the metal. As a result of this, the flow spinning process does not create undesirable stresses in the material which require additional cold or hot working steps to relieve these undesirable stresses. In addition, the flow spinning process of step 14 results in optimum physical characteristics, i.e., strength and resiliency, in the finished disc 60 using a minimum amount of material. Prior art stamped discs added excessive material, and therefore weight, to portions of the disc where it is not required for strength. As a result of this, the material cost for producing a full face fabricate wheel according to the method of the present invention is less than the material cost to produce a full face wheel according to the prior art method.

For example, a 16×7 inch steel disc 60 produced according to the method of the present invention weighs approximately 12 pounds, whereas a similar designed 16×7 inch steel disc produced according to a prior art stamping method weighs approximately 28 pounds. Also, a 16×7 inch aluminum disc 60 produced according to the method of the present invention weighs approximately 8 pounds, whereas a similar designed 16×7 inch aluminum disc produced according to the prior art stamping method weighs approximately 14 pounds. Thus, the finish disc 60, and therefore the finish full face fabricated wheel 90 produced according to the method of the present invention, weighs substantially less than a full face fabricated wheel produced according to the prior art method.

In addition, the finish full face fabricated wheel 90 of the present invention can be produced in a fewer total number of metal working steps compared to the total number of metal working steps needed to produce a prior art full face fabricated wheel. Therefore, the manufacturing cost to produce the full face wheel 90 of the present invention is less compared to the cost to produce a prior art full face wheel.

It will be appreciated that while the invention has been described and illustrated as tapering the intermediate annular portion 54 and the outer annular portion 52 during the flow spinning process of step 14, the intermediate annular portion 54 and the outer annular portion 52 can have a constant thickness. In addition, only the intermediate annular portion 54 can be tapered, or only the outer annular portion 52 can be tapered during the flow spinning process of step 14. Also, while the flow spinning process of step 14 has been used to both axially and radially increase the dimensions of the partially-shaped 0 disc, the flow spinning process can be used to increase only the axial dimension of the partially-shaped disc.

In addition, while the invention has been described and illustrated as forming the lug receiving apertures 30 during the initial stamping of the blank 20 in step 12, the lug mounting apertures 28 can be formed in the blank 20 prior to step 12, or subsequent to step 12. Also, depending upon the desired finished disc profile, the outer surface of the mandrel 36 can include other contours than the one shown in FIGS. 6 and 7.

In accordance with the provisions of the patent statutes, the principle and mode of operation of this invention have been described and illustrated in its preferred embodiment. However, it must be understood that the invention may be practiced otherwise than as specifically explained and illustrated without departing from its spirit or scope.

What is claimed:

1. A method for producing a full face fabricated wheel comprising the steps of:

(a) providing a generally circular rim defining an axis and including a generally axially extending well and a pair of opposed ends, one of the ends including an inboard tire bead seat retaining flange and an inboard tire bead seat, and the other end including an outboard tire bead seat;

(b) providing a generally circular disc blank including an inner annular portion defining a wheel mounting surface;

(c) flow spinning the disc blank to form an intermediate annular portion having a predetermined contour and an outer annular portion;

(d) stamping the outer annular portion of the disc to form an outboard tire bead seat retaining flange of the full face wheel;

(e) positioning the outboard tire bead seat retaining flange of the disc adjacent the outboard tire bead seat of the rim; and (f) securing the rim and disc together to produce the full face fabricated wheel.

2. The method according to claim 1 wherein said step (c) includes flow spinning the disc blank to form a tapered intermediate annular portion.

3. The method according to claim 1 wherein said step (c) includes flow spinning the disc blank to form a tapered outer annular portion.

4. The method according to claim I wherein said step (c) includes flow spinning the disc blank to form a tapered intermediate annular portion and a tapered outer annular portion.

* * * * *